US007170733B2

(12) United States Patent
Colombo et al.

(10) Patent No.: US 7,170,733 B2
(45) Date of Patent: Jan. 30, 2007

(54) ELECTRIC POLE FOR LOW-VOLTAGE POWER CIRCUIT BREAKER

(75) Inventors: Severino Colombo, Dalmine (IT); Osvaldo Carrara, Casnigo (IT)

(73) Assignee: ABB Services S.r.l., Milan (IT)

( * ) Notice: Subject to any disclaimer, the term of this patent is extended or adjusted under 35 U.S.C. 154(b) by 515 days.

(21) Appl. No.: 10/451,550

(22) PCT Filed: Dec. 12, 2001

(86) PCT No.: PCT/EP01/14697

§ 371 (c)(1),
(2), (4) Date: Jun. 24, 2003

(87) PCT Pub. No.: WO02/054430

PCT Pub. Date: Jul. 11, 2002

(65) Prior Publication Data

US 2004/0066596 A1 Apr. 8, 2004

(30) Foreign Application Priority Data

Dec. 28, 2000 (IT) ..... M2000A2850

(51) Int. Cl.
*H01H 73/00* (2006.01)

(52) U.S. Cl. ..... 361/115; 361/116

(58) Field of Classification Search ..... 361/42, 361/43, 44, 45, 46, 47–50, 115, 116; 335/18; 439/376, 76.1, 638

See application file for complete search history.

(56) References Cited

U.S. PATENT DOCUMENTS 4,281,359 A * 7/1981 Bayer et al. ..... 361/115
4,368,394 A 1/1983 Naimer
4,739,450 A * 4/1988 Misencik ..... 361/733
5,162,766 A * 11/1992 Morris et al. ..... 335/202
5,218,331 A 6/1993 Morris et al.
6,141,197 A 10/2000 Kim et al.

* cited by examiner

*Primary Examiner*—Brian Sircus
*Assistant Examiner*—Danny Nguyen
(74) *Attorney, Agent, or Firm*—Connolly Bove Lodge & Hutz LLP; Larry J. Hume

(57) ABSTRACT

An electric pole (1) for a low-voltage automatic power circuit breaker, comprising: a fixed contact (2) and a movable contact (3) that can be coupled/uncoupled with respect to each other, said fixed contact being electrically connected to a phase conductor, and a sensing unit that comprises a first section suitable to accommodate a current sensor associated with the phase conductor, the current sensor generating sensing signals that are indicative of the intensity of the electrical current that flows through the phase conductor, the sensing unit being electrically connected to a protection unit of the automatic power circuit breaker, the protection unit being suitable to receive the sensing signals and to generate control signals for actuation means operatively connected to said movable contact, and comprising at least one input section (14) provided with one or more electrical input terminals (141); whose particularity consists of the fact that the sensing unit comprises a second section (20), which is rigidly connected to the first section and is provided with one or more electrical output terminals that are electrically connected to the current sensor, the second section comprising connection means that are suitable to mechanically couple the second section to the input section of the protection unit, so as to provide a direct electrical connection between the electrical output terminals of the second section and the electrical input terminals of the input section.

9 Claims, 4 Drawing Sheets

ELECTRIC POLE FOR LOW-VOLTAGE POWER CIRCUIT BREAKER

BACKGROUND

The present invention relates to an electric pole for a low-voltage power circuit breaker having improved features.

More particularly, the present invention relates to an electric pole for a low-voltage automatic power circuit breaker having improved reliability and ease of use.

It is known that a low-voltage automatic power circuit breaker is a circuit breaker used in industrial electrical systems characterized by operating voltages below 1000 volts and by electric currents whose nominal value can vary from fractions of an ampere to several thousand amperes, leading to relatively high power levels.

It is known that an automatic power circuit breaker comprises one or more electric poles, with each of which a phase electrical conductor or a neutral electrical conductor is associated. Depending on the number of electric poles used, an automatic power circuit breaker is termed single-pole, two-pole, three-pole, four-pole, et cetera.

Usually, an electric pole comprises two electrical contacts that can be mutually coupled/uncoupled. The electrical contacts are electrically connected to the phase or neutral conductor associated with the electric pole.

Generally, each electric pole of the circuit breaker comprises a current sensor associated with the phase or neutral conductor. The current sensor normally comprises a current sensing transformer, whose primary winding is constituted by the phase or neutral conductor and whose secondary winding is electrically connected, by virtue of electrical output terminals, to the protection unit of the circuit breaker, also known as overcurrent relay. Accordingly, at the output of the secondary winding the current sensing transformer generates sensing signals that are indicative of the value of the intensity of the current in the phase or neutral conductor. The sensing signals are sent in input to the protection unit, which provides in output control signals for an actuation device. In this manner, for each electrical phase it is possible to constantly sense the absorption conditions of the load, recognize any anomalies of operation and, if necessary in case of malfunction, overcurrent, short circuit, automatically open the circuit breaker.

It is known that the electrical connection of the current sensor to the protection unit can occur in various manners.

According to a first conventional approach, the current sensing transformer is connected to an electronic interface card, which in turn is electrically connected to the input section of the protection unit. In practice, the current sensing transformer is mounted on the electronic interface card and the electrical output terminals of the transformer, connected to the secondary winding thereof, are soldered to conductors formed on the electronic interface board. These conductors are connected electrically, by virtue of soldered junctions or appropriate connectors, to the electrical terminals of the input section of the protection unit.

An alternative conventional approach instead entails soldering appropriate electrical cables to the electrical output terminals of the transformer and connecting (by soldering or by means of appropriate connectors) said electrical cables directly to the electrical terminals of the input section of the protection unit.

Electric poles for low-voltage power circuit breakers of the known type have drawbacks.

These drawbacks arise from the fact that the electrical connection between the current sensor and the protection unit usually provides for a relatively large number of soldered joints and electrical junctions. During the operating life of the circuit breaker, these soldered joints and junctions can be subject to deterioration and separation, for example due to the considerable vibration to which the electric pole is usually subjected during disconnections. The operating efficiency of the circuit breaker therefore depends on the perfect state of preservation of the electrical connectors and cables. Therefore, it is quite often necessary to perform difficult and expensive maintenance interventions in order to ensure adequate reliability. Clearly this has negative repercussions on the overall manufacturing and operating costs of the low-voltage circuit breaker.

SUMMARY

The aim of the present invention is to provide an electric pole for a low-voltage automatic power circuit breaker that allows to overcome the described drawbacks.

Within the scope of this aim, an object of the present invention is to provide an electric pole in which the electrical connection between the current sensor associated with the pole and the protection unit of the circuit breaker is provided in a simple and reliable manner, avoiding complicated joining and soldering operations.

Another object of the present invention is to provide an electric pole that has a reduced number of parts, simplified wiring and is relatively simple to assemble and install.

Another object of the present invention is to provide an electric pole that is easy to manufacture and at a modest cost.

This aim and these and other objects that will become better apparent hereinafter are achieved by an electric pole for a low-voltage automatic power circuit breaker, comprising a fixed contact and a movable contact that can be coupled/uncoupled with respect to each other. The fixed contact is electrically connected to a phase conductor that is suitable to supply power to a load. The electric pole according to the present invention furthermore comprises a sensing unit that comprises a first section suitable to accommodate a current sensor associated with said phase conductor. The current sensor is capable of generating sensing signals that are indicative of the intensity of the electrical current that flows through said phase conductor. The sensing unit is connected to the protection unit of the circuit breaker, which is suitable to receive said sensing signals and to generate control signals for actuation means operatively connected to said movable contact. The protection unit comprises at least one input section, provided with one or more electrical input terminals. The electric pole according to the present invention is characterized in that said sensing unit comprises a second section, which is rigidly connected to said first section and is provided with one or more electrical output terminals that are electrically connected to said current sensor. Said second section comprises connection means that are suitable to mechanically couple said second section to the input section of the protection unit, so as to provide a direct electrical connection between the electrical output terminals of said second section and the electrical input terminals of said input section of the protection unit.

In one aspect of the disclosure, the conducting element comprises a first substantially rigid portion that protrudes from said first section of said sensing unit and is electrically connected to said phase conductor by means of a first connection terminal; a second flexible portion that is at least partially enclosed by said first section of said sensing unit and comprises one or more turns wound on said magnetic core; and a third substantially rigid portion that protrudes from the first section of said sensing unit and is electrically connected to said fixed contact by means of a second connection terminal.

BRIEF DESCRIPTION OF THE DRAWINGS

Further characteristics and advantages will become better apparent from the description of a preferred but not exclusive embodiment of the electric pole according to the present invention, illustrated only by way of non-limitative example in the accompanying drawings, wherein.

DETAILED DESCRIPTION

Figure 1:
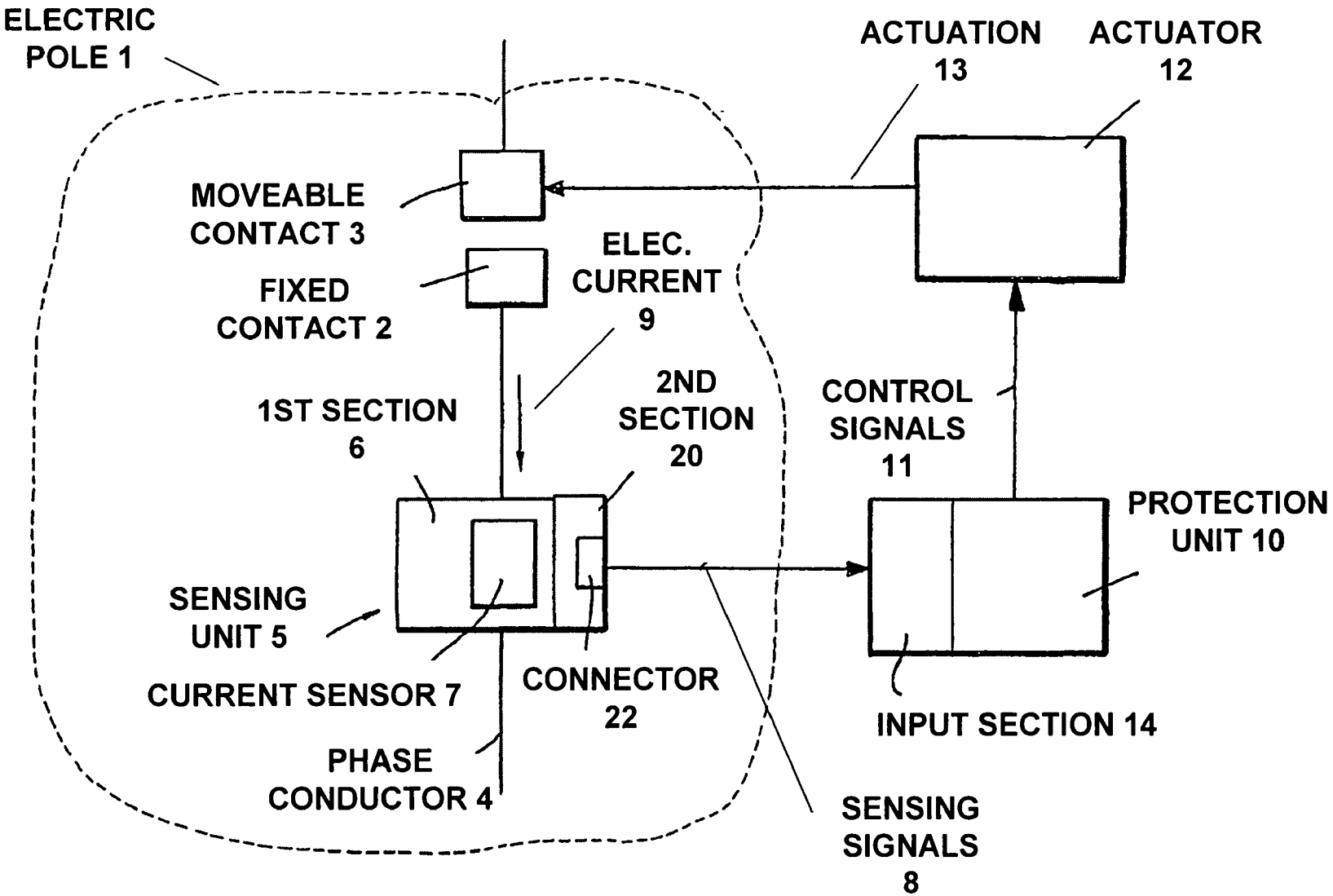
FIG. 1 is a view representing schematically the structure of an electric pole according to the present invention.
Figure 3:
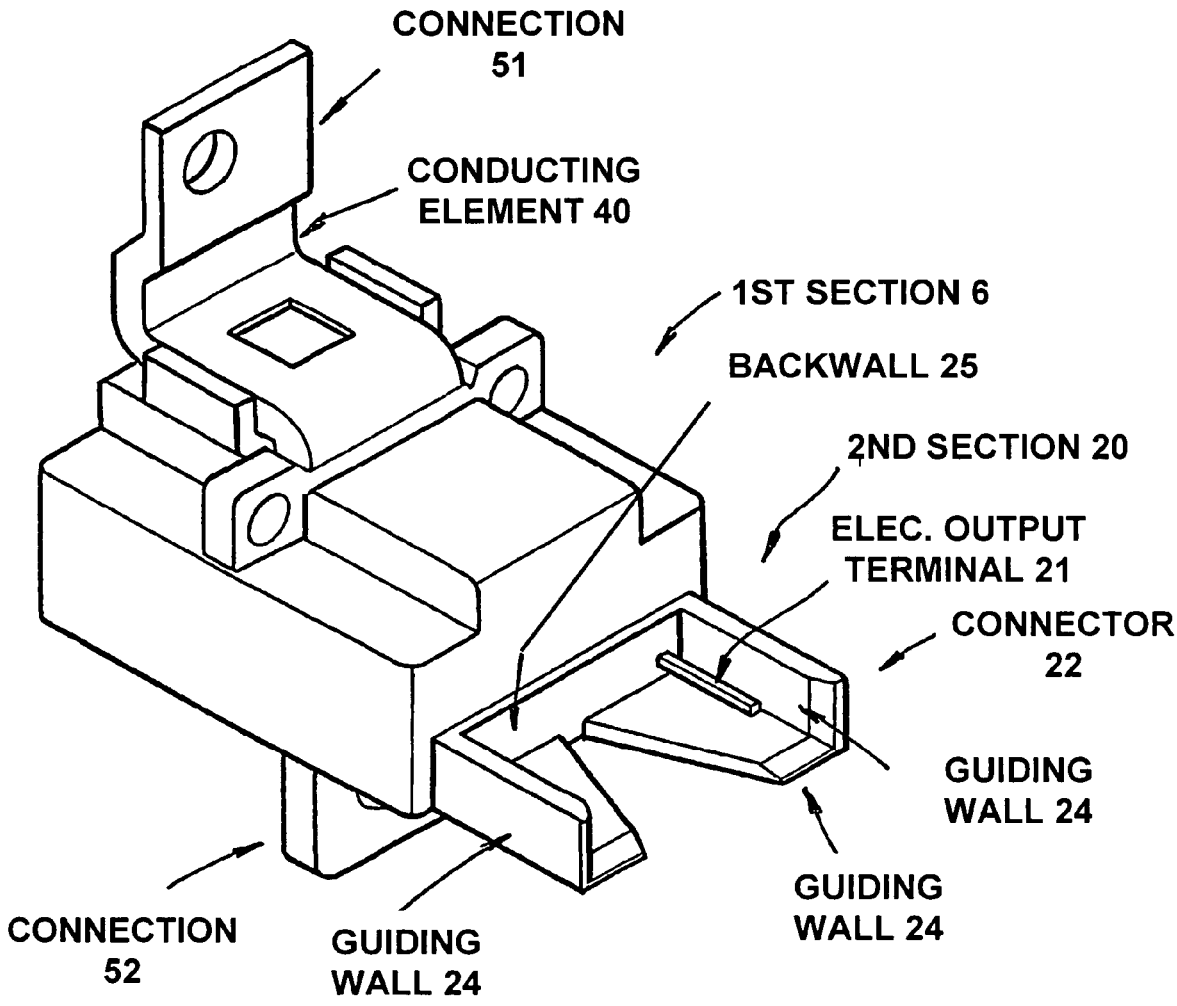
FIG. 3 is a schematic view of a preferred embodiment of a sensing unit used in the electric pole according to the present invention.

With reference to the figures, the electric pole according to the present invention this disclosure, generally designated by the reference numeral 1, comprises a fixed contact 2 and a movable contact 3 that can be mutually coupled/uncoupled. The fixed contact 2 is electrically connected to a phase conductor 4 that is suitable to supply a load (not shown). The electric pole 1 furthermore comprises a sensing unit 5. The sensing unit 5 comprises a first section 6 that is suitable to accommodate a current sensor 7 associated with the phase conductor 4. The current sensor 7 generates sensing signals 8 that are indicative of the intensity of the electric current (arrow 9 of FIG. 1) that flows through the phase conductor 4. The circuit breaker also comprises a protection unit 10 that is electrically connected to the sensing unit 5 and is suitable to receive the sensing signals 8 and to generate control signals 11 for actuator or actuation means 12 that are operatively connected to the movable contact 3 (actuation arrow 13 of FIG. 1). The protection unit 10 comprises at least one input section 14, which is provided with one or more first input terminals (not shown). The particularity of the electric pole 1 according to the present invention consists of the fact that the sensing unit 5 comprises a second section 20 that is monolithically connected to the first section 6 and is provided with one or more second electrical terminals 21 (FIG. 3). The second section comprises connector or connection means 22 that are suitable to mechanically couple the input section 14 of the protection unit 10, not shown in FIG. 3, to the second section 20 of the sensing unit 5. The mechanical coupling occurs so as to provide a direct electrical connection between the first electric terminals 21 of the second section 20 and the second electric terminals of the input section 14 (which are not shown). In this manner, the electrical connection between the current sensor 7 and the sensing unit 5 is provided simply and directly, avoiding in practice the adoption of junctions, soldered joints, connecting cables or intermediate connectors. Clearly, this leads to high reliability, to a considerable reduction in the number of elements used, and to a considerable simplification of the wiring of the electric pole.

According to a preferred embodiment illustrated in FIG. 3, the connection means 22 comprise a first connector element that comprises one or more guiding walls 24 and a back wall 25 from which the electrical output terminals 21 of the first section 6 protrude. The guiding walls 24 and the back wall 25 form a first receptacle that is suitable to accommodate at least partially, and particularly at the electrical input terminals, a second connecting element (not shown) of the input section 14. In this manner it is possible to provide a direct electrical connection between the electrical output terminals 21 and the second electrical terminals of the input section 14, in a plug-and-socket fashion. For example, during the connection operation, the electrical output terminals 21 can be inserted in appropriate terminals that can be provided on the input section 14 of the protection unit 10 and accordingly in practice can constitute the electrical input terminals of the input section 14.

According to an alternative embodiment (not shown) of the electric pole 1 according to the present invention, the connection means 22 comprise auxiliary connection elements that are suitable to be accommodated in receptacles formed in the input section 14 of the protection unit 10. In this manner, too, it is possible to provide easily a direct electrical connection between the first electrical terminals 21 and the second electrical terminals of the input section 14 of the protection unit 10, in a plug-and-socket fashion.

Figure 2:
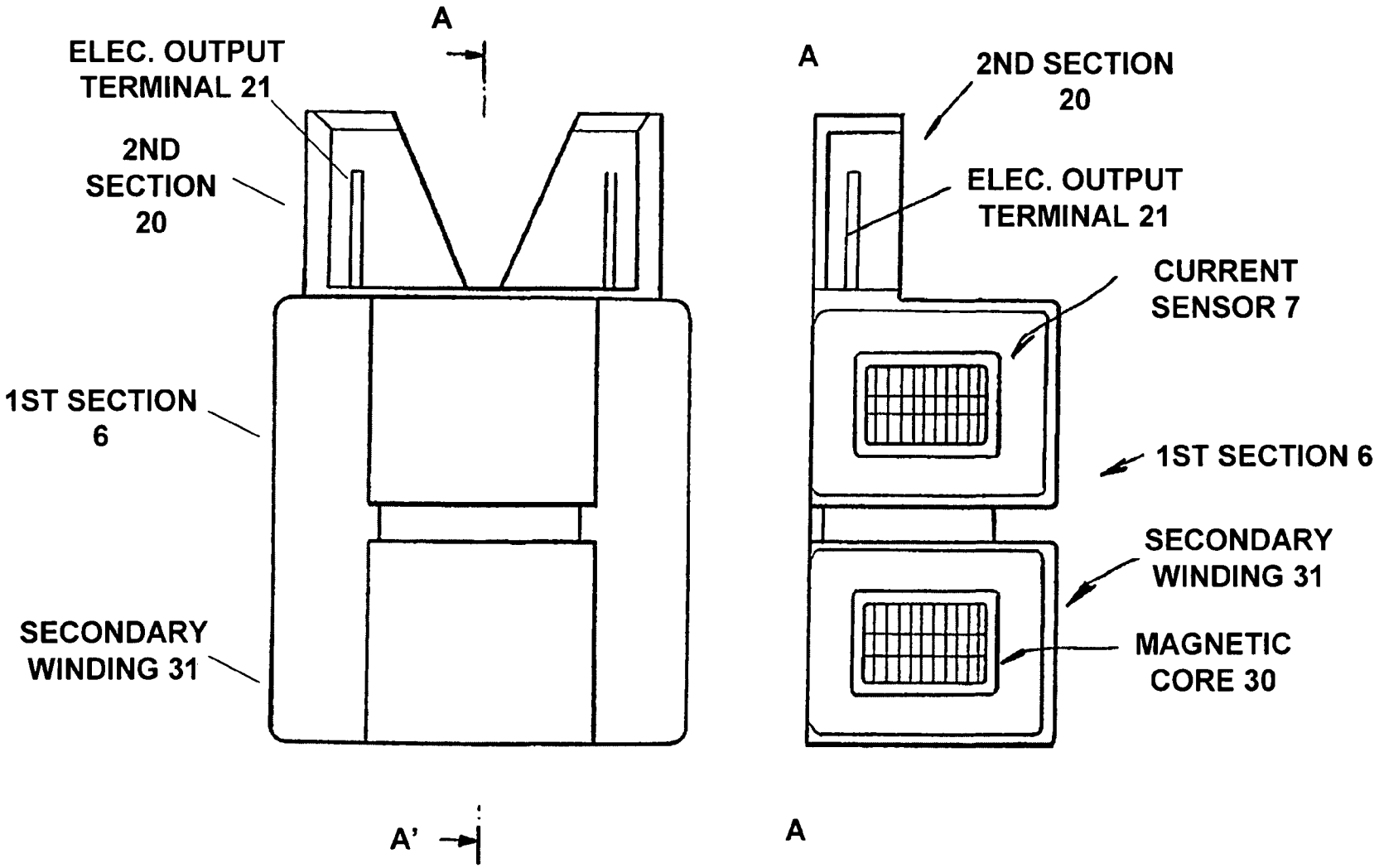
FIG. 2 is a schematic view of an embodiment of a sensing unit used in the electric pole according to the present invention.

As described above, the second section 20 is monolithically connected to the first section 6 of the sensing unit 5. This can occur with the aid of screws or other mechanical connection elements. Preferably, however, the first section 6 and the second section 20 are obtained monolithically from a single containment body made of insulating plastic material. Advantageously, as illustrated in FIG. 2, the current sensor 7 and the electrical output terminals 21 can be embedded in the plastic containment body of the sensing unit 5. This can be achieved by using, for example, a molding-in-place process. This solution is particularly advantageous, since it allows to provide a sensing unit 5 that has considerable solidity, particularly at the second section 20. This allows to obtain with relative ease a sturdy mechanical coupling between the input section of the protection unit 14 and the second section 20 and accordingly obtain a direct electrical connection between the electrical terminals 21 and the electrical input terminals of the input section 14 that is particularly solid and strong.

Figure 4:
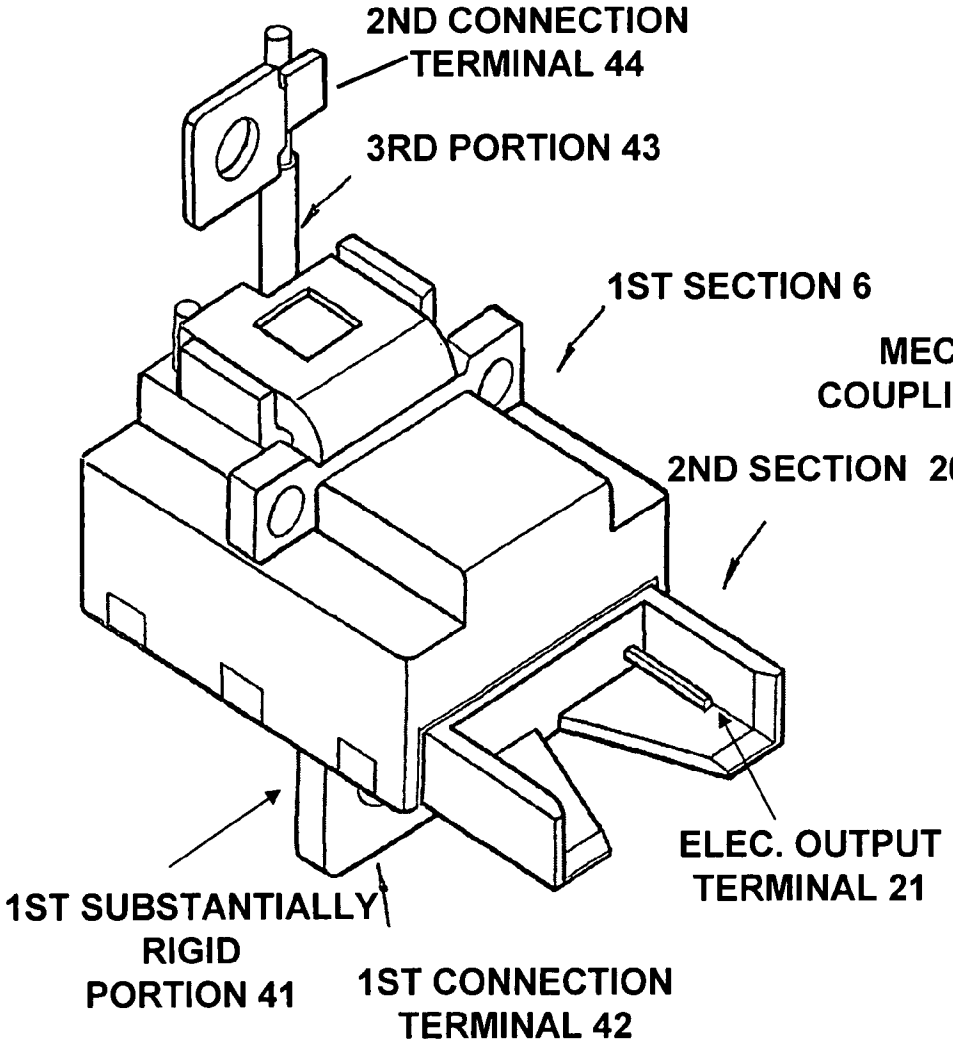
FIG. 4 is a schematic view of a further embodiment of a sensing unit used in the electric pole according to the present invention.

The current sensor 7 can be provided according to techniques that are known in the art. Preferably, the current sensor 7 comprises a magnetic core 30 and a primary winding (not shown in FIG. 2) that is electrically connected to the fixed contact 2. The current sensor 7 is advantageously also provided with a secondary winding 31 that comprises one or more turns wound onto the magnetic core 30. The secondary winding 31 is electrically connected to the electrical terminals 21 of the second section 20. Preferably, as illustrated in FIGS. 3 and 4, the primary winding of the current sensor 7 comprises a conducting element 40 that is electrically connected to the phase conductor 4 and to the fixed contact 2. In the preferred embodiment of FIG. 3, the conducting element 40 is substantially rigid and passes through the first section 6. It is furthermore arranged so as to be enclosed by the magnetic core 30 of the current sensing transformer (single-turn primary winding of the current sensor). The conducting element 40 can be connected to the fixed contact 2 and to the phase conductor 4, respectively by virtue of the connections 51 and 52, and can preferably be inserted/removed from the first section 6 by virtue of an appropriate through hole.

As an alternative illustrated in FIG. 4, the conducting element 40 comprises a first substantially rigid portion 41 that protrudes from the first section 6 and is electrically connected to the phase conductor 4 (not shown in FIG. 4) by virtue of a first connecting terminal 42. The conducting element 40 also encloses a second flexible portion (not shown), which is preferably enclosed by the first section 6 and comprises one or more turns wound onto the magnetic core 30 (multiple-turn primary winding of the current sensor). Finally, the conducting element 40 comprises a third portion 43 that is substantially rigid. The third portion 43 protrudes from the first section 6 and can be electrically connected to the fixed contact 2 by virtue of a second connection terminal 44.

In this case also, at least one portion of the conducting element 40, particularly the mentioned second flexible portion, can be easily incorporated in the containment body of the sensing unit 5 by virtue of a molding-in-place process.

Figure 5:
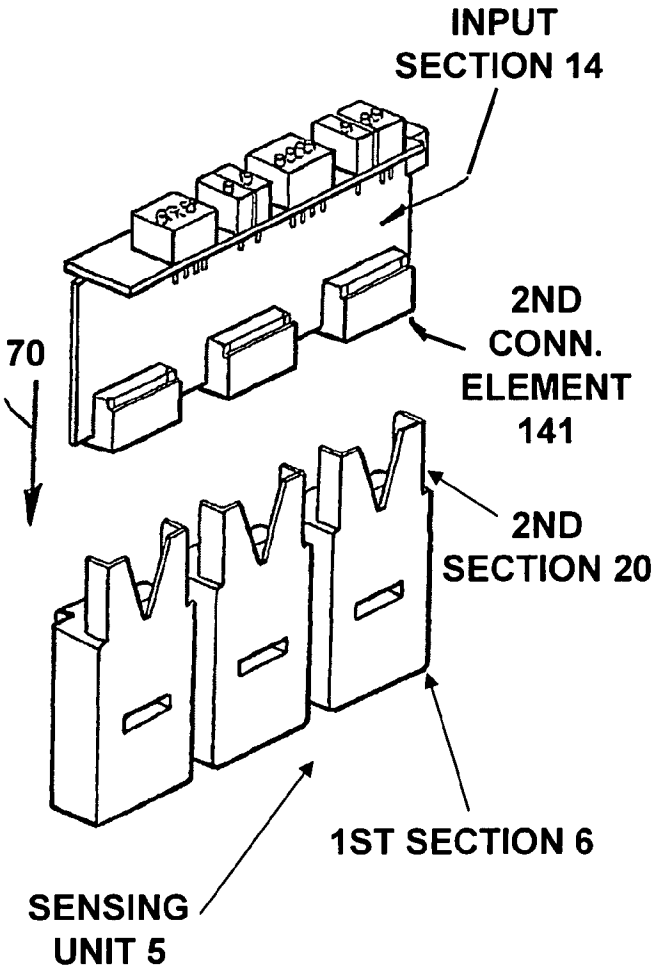
FIG. 5 is a partial view of an example of use of the electric pole according to the present invention in a three-pole circuit breaker.

The electric pole 1 according to the present invention can be easily used to provide single- or multipole circuit breakers. FIG. 5 shows, with reference to a three-pole circuit breaker, the connection between the sensing unit 5 and the protection unit 10, for the set of electric poles of the circuit breaker. In this case, the protection unit 10 comprises multiple second connecting elements 141 on the input section 14. Advantageously, the input section 14 can also accommodate additional connecting elements that are preset for connection to first connecting elements related to sensing units applied to any phases that are not interrupted by the poles of the circuit breaker. The input section 14 can be easily coupled mechanically (arrow 70) to each second section 20 of the sensing unit 5 related to each electric pole. In this manner, one obtains a mechanical and electronic connection that is particularly simple and strong. The strength of the assembly can be further increased by providing a single containment body that incorporates the three different sensing units 5.

In practice it has been found that the electric pole according to the present invention allows to fully achieve the intended aim and objects.

The use of the connection means 22 allows to reduce the number of junctions and electrical soldered joints required in order to electrically connect the sensing unit 5 to the protection unit 10, with considerable benefits in terms of reliability and strength. Furthermore, by virtue of the use of the connection means 22, it is possible to achieve a drastic reduction in the number of components, which entails a considerable simplification of the wiring and of the operations for assembling and installing the electric pole. This fact of course entails a reduction of the operating costs of the circuit breaker in which the electric pole according to the present invention is inserted.

Moreover, practice has demonstrated that the electric pole according to the present invention can be produced with methods that are relatively easy to implement and at low costs.

The electric pole for low-voltage circuit breakers thus conceived is susceptible of numerous modifications and variations, all of which are within the scope of the inventive concept.

All the details may further be replaced with other technically equivalent elements. In practice, the materials used, so long as they are compatible with the specific use, as well as the dimensions, may be any according to requirements and to the state of the art.

The invention claimed is:

1. An electric pole for a low-voltage automatic power circuit breaker, comprising:

a fixed contact and a movable contact that can be coupled/uncoupled with respect to each other, said fixed contact being electrically connected to a phase conductor; and a sensing unit that comprises a first section suitable to accommodate a current sensor associated with said phase conductor, said current sensor generating sensing signals that are indicative of the intensity of the electrical current that flows through said phase conductor, said sensing unit being electrically connected to a protection unit of said automatic power circuit breaker, said protection unit being suitable to receive said sensing signals and to generate control signals for actuation means operatively connected to said movable contact and comprising at least one input section provided with one or more electrical input terminals;

wherein said sensing unit comprises a second section, which is rigidly connected to said first section and is provided with one or more electrical output terminals that are electrically connected to said current sensor, said second section comprising connection means that are suitable to mechanically couple said second section to the input section of the protection unit, so as to provide a direct electrical connection between the electrical output terminals of said second section and the electrical input terminals of said input section, wherein said connection means comprise a first connector element that comprises one or more guiding walls and a back wall from which the electrical output terminals of said second section protrude, said guiding walls and said back wall forming a first receptacle that is suitable to accommodate a second connector element of said input section, so as to provide a direct electrical connection between the electrical output terminals of said second section and the electrical input terminals of said input section, in a plug-and-socket fashion.

2. The electric pole for low-voltage automatic power circuit breaker according to claim 1, characterized in that said connection means comprise one or more auxiliary connector elements that are suitable to be accommodated in receptacles formed in said input section, so as to provide a direct electrical connection between the electrical output terminals of said second section and the electrical input terminals of said input section, in a plug-and-socket fashion.

3. The electric pole for low-voltage automatic power circuit breaker according to claim 1, characterized in that said input section accommodates additional connector elements that are preset for connection to one or more first connection elements related to sensing units applied to any phases that are not interrupted by the poles of said circuit breaker.

4. The electric pole for low-voltage automatic power circuit breaker according to claim 1, characterized in that said first section and said second section are incorporated in a single containment body.

5. The electric pole for low-voltage automatic power circuit breaker according to claim 1, characterized in that said current sensor comprises:

a magnetic core;

a primary winding; and a secondary winding, which comprises one or more turns wound on said magnetic core, said secondary winding being electrically connected to the electrical output terminals of said second section.

6. An electric pole for a low-voltage automatic power circuit breaker, comprising:

a fixed contact and a movable contact that can be coupled/uncoupled with respect to each other, said fixed contact being electrically connected to a phase conductor; and a sensing unit that comprises a first section suitable to accommodate a current sensor associated with said phase conductor, said current sensor generating sensing signals that are indicative of the intensity of the electrical current that flows through said phase conductor, said sensing unit being electrically connected to a protection unit of said automatic power circuit breaker, said protection unit being suitable to receive said sensing signals and to generate control signals for actuation means operatively connected to said movable contact and comprising at least one input section provided with one or more electrical input terminals;

wherein said sensing unit comprises a second section, which is rigidly connected to said first section and is provided with one or more electrical output terminals that are electrically connected to said current sensor, said second section comprising connection means that are suitable to mechanically couple said second section to the input section of the protection unit, so as to provide a direct electrical connection between the electrical output terminals of said second section and the electrical input terminals of said input section, wherein said connection means comprise one or more auxiliary connector elements that are suitable to be accommodated in receptacles formed in said input section, so as to provide a direct electrical connection between the electrical output terminals of said second section and the electrical input terminals of said input section, in a plug-and-socket fashion.

7. The electric pole for low-voltage automatic power circuit breaker according to claim 6, characterized in that said input section accommodates additional connector elements that are preset for connection to one or more first connection elements related to sensing units applied to any phases that are not interrupted by the poles of said circuit breaker.

8. The electric pole for low-voltage automatic power circuit breaker according to claim 6, characterized in that said first section and said second section are incorporated in a single containment body.

9. The electric pole for low-voltage automatic power circuit breaker according to claim 6, characterized in that said current sensor comprises:

a magnetic core;

a primary winding; and a secondary winding, which comprises one or more turns wound on said magnetic core, said secondary winding being electrically connected to the electrical output terminals of said second section.

* * * * *